US006009567A

United States Patent [19]

Dean et al.

[11] Patent Number: 6,009,567

[45] Date of Patent: Jan. 4, 2000

[54] INLINE SANITARY CONDITIONING SYSTEM

[75] Inventors: John J. Dean, Oxford; Nicholas A. Velezis, Middlebury, both of Conn.

[73] Assignee: Waterbury Companies, Inc., Waterbury, Conn.

[21] Appl. No.: 09/167,067

[22] Filed: Oct. 6, 1998

[51] Int. Cl.[7] ..... E03D 9/02

[52] U.S. Cl. ..... 4/226.1; 4/224; 4/309

[58] Field of Search ..... 4/226.1, 227.6, 4/222–225.1, 302, 304, 309, 228.1, 231; 137/268

[56] References Cited

U.S. PATENT DOCUMENTS

| | | | |
|---|---|---|---|
| 1,745,010 | 1/1930 | Lamprecht | 4/226.1 |
| 4,331,174 | 5/1982 | King, Sr. | 137/268 |
| 4,937,892 | 7/1990 | Syrenne | 4/226 |
| 5,367,716 | 11/1994 | Huang | 4/228.1 |
| 5,449,117 | 9/1995 | Muderlak et al. | 239/6 |
| 5,513,394 | 5/1996 | Kodaira | 4/224 |

FOREIGN PATENT DOCUMENTS

| | | | |
|---|---|---|---|
| 4421 | 10/1879 | United Kingdom | 4/231 |
| 468282 | 6/1937 | United Kingdom | 4/226.1 |

*Primary Examiner*—Henry J. Recla
*Assistant Examiner*—Tuan Nguyen
*Attorney, Agent, or Firm*—St. Onge Steward Johnston & Reens LLC

[57] ABSTRACT

An inline sanitary conditioning system for a toilet or urinal system comprises a hollow body plumbed into a flush line between the flush valve and the bowl of the toilet or urinal. A cage is mounted into a chamber in the body through which the flush water passes. A solid tablet comprised of a soluble sanitary conditioning material is retained in the cage so that actuation of the flush valve causes water to flow through the upper end of the body into the chamber to dissolve a portion of the solid tablet to form a sanitary conditioning solution which is delivered to the bowl of the toilet or urinal. Preferably, electronic sensing apparatus are provided to detect users of the urinal or toilet, count the number of users, and activate a signal to alert maintenance personnel of the need to replace the sanitary conditioning tablet after 2000 or more users (or any other number) have been counted or predetermined number of days have elapsed.

10 Claims, 3 Drawing Sheets

INLINE SANITARY CONDITIONING SYSTEM

FIELD OF THE INVENTION

The present invention relates to the field of sanitizing and cleaning restroom facilities such as toilets and urinals.

BACKGROUND OF THE INVENTION

In public restrooms it is desirable to provide for frequent cleaning and sanitation of the toilets and urinals to minimize any risk to public health that may arise from the use of such equipment by numerous persons. To that end, a variety of systems have been used. One system used in the past, known as a drip system, has used a reservoir hung on the wall adjacent to the urinal or toilet, containing a liquid disinfectant that is released via a wick or tube into the reservoir or toilet at periodic intervals, as disclosed in U.S. Pat. No. 5,449,117. In other systems, a solid disinfectant is provided in a reservoir connected with the main flush water line such that water containing the dissolved disinfectant is provided from the reservoir to the urinal the flush cycle, and the reservoir is refilled via a by-pass line after having being emptied in the flush cycle. One example of such a system is shown in U.S. Pat. No. 4,937,892. Another similar system is disclosed in U.S. Pat. No. 5,513,394.

It has been found that in general such systems are complicated to use, and are prone to overflow and/or plugging of the by-pass lines or tubes after extensive use. The drip systems also tend to deliver their cleaning agents only in the center of a urinal, and do not operate to sanitize more remote comers of the urinal. In addition, it is to be appreciated that the deodorant/disinfectant used therein will be depleted over time and that such systems generally require a periodic checking of the deodorant/disinfectant solution to assure that the system is still performing its intended function.

It would therefore be desirable to provide a sanitary conditioning system for urinals and toilets which is simple to install and free of overflow or clogging and plugging problems, and in which provides appropriate notice to maintenance personnel for replacement of the deodorizing/cleaning agent element.

SUMMARY OF THE INVENTION

It is an object of the invention to provide an inline sanitary conditioning system for urinals and toilets which is simple to operate and which is unlikely to suffer problems of overflow, or clogging of the deodorizing/cleaning agent.

It is a further object of the invention to provide an inline sanitary conditioning system which provides notification to maintenance personnel of the need to replace the deodorizing/cleaning agent element.

In accordance with one embodiment of the invention, an inline sanitary conditioning system is provided in a toilet or urinal system. The toilet or urinal system has a flush valve, and a flush line connecting the flush valve to an inlet of a bowl of the toilet or urinal. The inline sanitary conditioning apparatus has a hollow body with open upper and lower ends. The inline sanitary conditioning apparatus is mounted in the flush line by connecting means provided at its upper and lower ends, so that the body is inline with the flush line between the flush valve and the bowl of the urinal or toilet. The body apparatus has a chamber therein having a diameter greater than 0.25 inch, and preferably about 1.75 inches. The apparatus body also has a laterally extending aperture that penetrates the body and connects to the chamber in the body.

A cage is mounted to the apparatus body so that it extends through the aperture and into the chamber. The cage has a diameter or other shapes or configurations which is less than the diameter or other shapes or configurations of the chamber. A solid end cap is provided at one end of the cage. The end cap has a diameter or other shapes or configurations greater than the cage diameter and greater than the diameter of the aperture. The end cap is mounted to the body apparatus by cooperating means provided on the end cap and the body. A seal is provided to seal the end cap to the body, preferably a sealing ring.

A solid tablet comprised of a soluble sanitary conditioning material is retained in the cage so that actuation of the flush valve causes water to flow through the upper end of the apparatus body into the chamber to dissolve a portion of the solid tablet to form a sanitary conditioning solution which is delivered to the urinal or the bowl of the toilet.

Preferably, at least one pocket for receiving an air freshening material is provided on a lateral side of the body. The pocket has openings to permit venting of an air freshening fragrance from the pocket. A removable or preferably, a hinged in any direction, lockable, movable cover encloses the body and cap.

Preferably, the inline sanitary conditioning system further comprises an electronic sensing apparatus having means for detecting the proximity of a person to the toilet or urinal; means for storing a sum representing a total of the number of detections determined by the detecting means; means for comparing the stored sum with a predetermined number; and means for displaying a signal when the comparing means determines that the stored sum exceeds the predetermined number, so that maintenance personnel are alerted to the need to replace the solid tablet and air freshening materials. The electronic apparatus also provides a signal when a certain number of days have passed, or when the battery powering such electronics requires replacement.

DETAILED DESCRIPTION OF THE INVENTION

Figure 1:
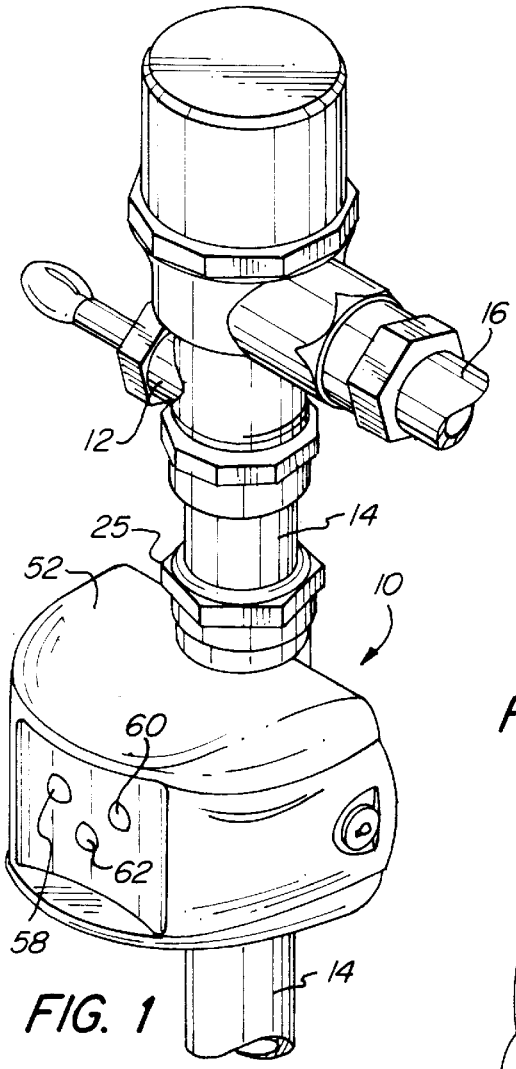
FIG. 1 is a perspective view of an assembled and installed inline sanitary conditioning system in accordance with an embodiment of the invention.
Figure 2:
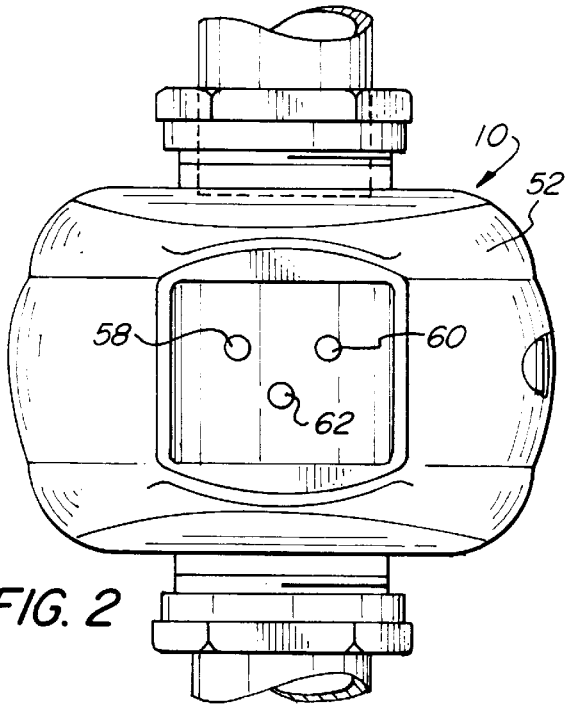
FIG. 2 is a front elevation view of the inline sanitary conditioning system of FIG. 1.
Figure 3:
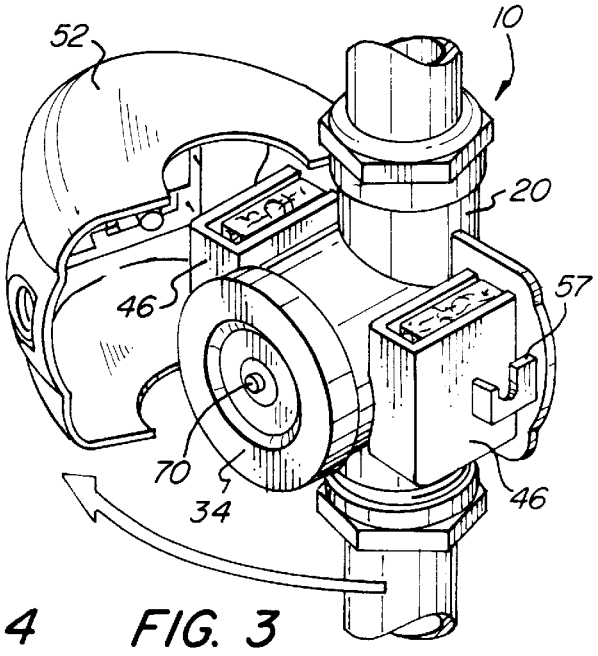
FIG. 3 is the perspective view of the assembled and installed inline sanitary conditioning system of FIG. 1 showing such system with the cover opened.
Figure 4:
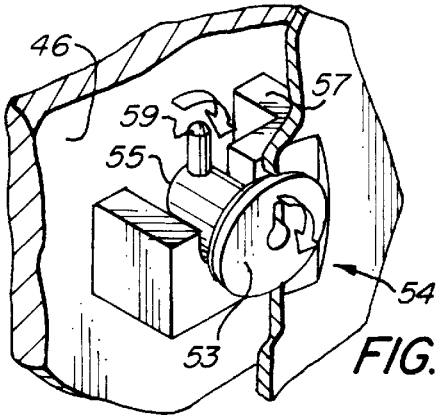
FIG. 4 is a detail view of FIG. 3, showing the lock mechanism for locking the cover of the inline sanitary conditioning system.
Figure 5:
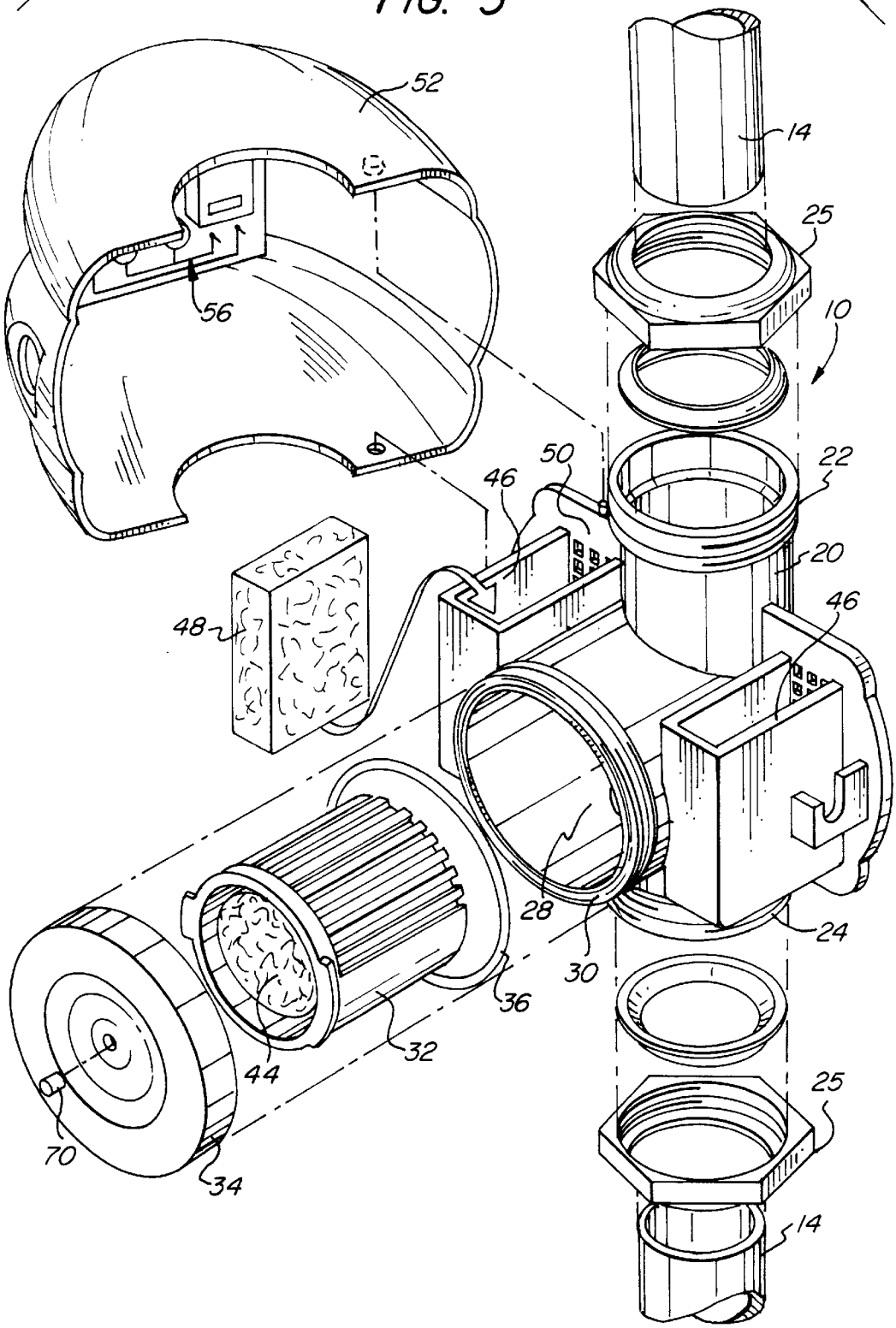
FIG. 5 is an exploded perspective view of the inline sanitary conditioning system of FIG. 1.
Figure 6:
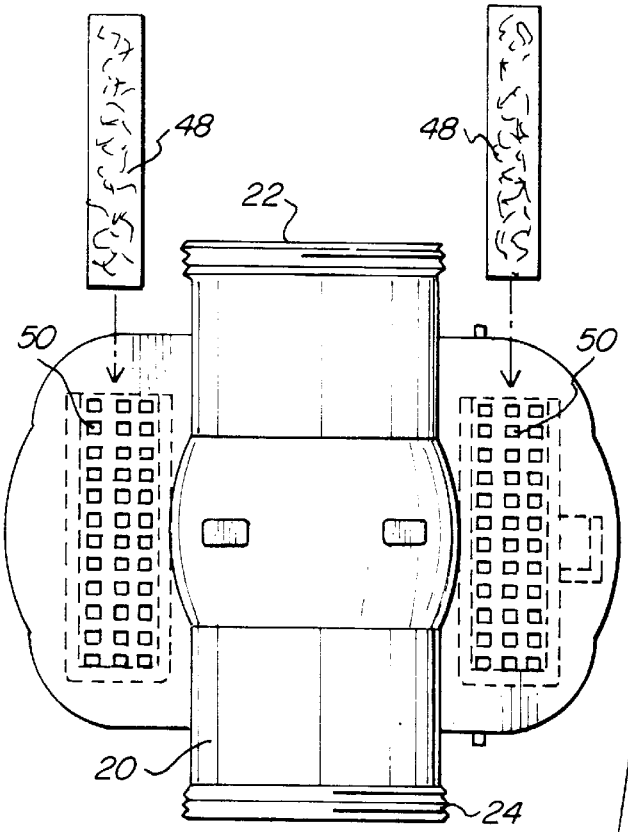
FIG. 6 is a rear perspective view of the inline sanitary conditioning system of FIG. 1.
Figure 7:
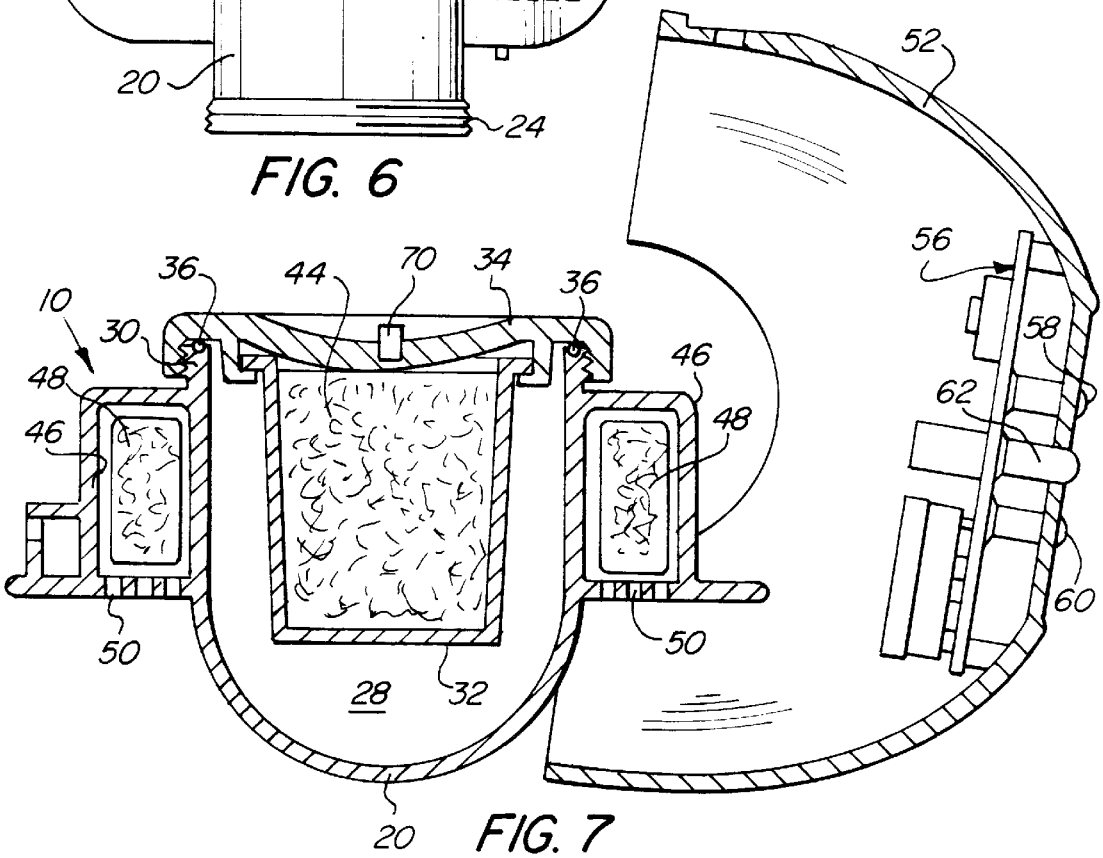
FIG. 7 is a cross-sectional view of the inline sanitary conditioning system of FIG. 3.

Referring now to FIGS. 1–7, where like numbers represent the same elements in the Figures, an inline sanitary conditioning system 10 is provided in a toilet or urinal system. The toilet or urinal system has a flush valve 12, and a flush line 14 connecting the flush valve 12 to an inlet of a bowl of the toilet or urinal. As is typical, the flush valve 12 is connected by pipes to a water supply 16. The inline sanitary conditioning apparatus 10 has a hollow body 20 with an open upper end 22 and an open lower end 24. The inline sanitary conditioning apparatus 10 is mounted in the flush line 14 by connecting means provided at the upper and lower ends 22 and 24 so that the body 20 is inline with the flush line 14. The connecting means will typically be pipe threading on the outer surfaces of the ends 22, 24 that mate with a pipe nuts 25 provided on the flush line. Other connecting means, including other pipe fittings, and snap lock fittings may be used.

The body 20 has a chamber 28 therein having a diameter or other shapes or configurations greater than 0.25 inch, and preferably about 1.75 inches. The body has a laterally extending aperture 30 that penetrates the body 20 and connects to the chamber 28.

A cage 32 is mounted to the body 20 so that it extends through the aperture 30 and into the chamber 28. The cage 32 is provided preferably with slits or semi slits, and solid section holes or other perforations to allow passage of water therethrough. The cage 32 can be any shape or configuration, preferably a cylindrical or frustoconical shape and has a diameter or other shapes or configurations which is less than the diameter or other shapes or configurations of the chamber 28. As used herein, "diameter" reflects a preferred embodiment which is circular in shape, but also encompasses non-circular shapes or configurations. The cage 32 inserted into the cage fitting is mounted to a solid end cap 34 by tabs extending laterally from the base of the cage fitting into an annular lip around the inside of the end cap 34. The cage after being mounted to the solid end cap has freedom of motion able to rotate. The end cap 34 has a diameter or other shapes or configurations greater than the diameter or other shapes or configurations of the cage 32 and greater than the diameter of the aperture 30. The end cap 34 is mounted to the body 20 by cooperating means provided on the end cap 34 and the body 20. A seal 36 is provided around the cage 32 at the inner face of the end cap 34 to provide a sealing fit of the end cap 34 to the body 20. Preferably, seal 36 is a sealing ring.

The cooperating means may be a snap fitting mounting, or a screw threaded connection, or other locking mechanisms. In the preferred embodiment, end cap 34 has internal screw threads that mate with external threading on body 20.

A solid tablet 44 comprised of a soluble sanitary conditioning material is retained in the cage 32 so that actuation of the flush valve causes water to flow through the upper end 22 of body 20 into the chamber 28 to dissolve a portion of the solid tablet 44, to form a sanitary conditioning solution which is delivered to the bowl of the toilet or urinal. Solid tablet 44 preferably comprises components for water softening, stain prevention, elimination of odor caused by bacteria, drain flow maintenance, sanitary conditioning, and fragrance. Thus, for example, solid tablet 44 is formulated to contain surfactants to clean the interior surfaces of the toilet or urinal bowl; borax to remove brown stains, scale and water deposits, and enzymes to eliminate organic materials such as bacteria. A coloring agent such as a blue dye may also be added to provide a visual indicator that the solid tablet continues to provide its sanitary conditioning materials.

Preferably, at least one, and preferably two pockets 46 for receiving an air freshening material 48 are provided on a lateral side of the body 20. The pockets have openings 50 to permit venting of an air freshening fragrance from the pockets 46. A suitable example of an air freshening material is the "Ozitape" manufactured and sold by Waterbury Companies, Inc. This material, or a fragrance pillow of a suitable size provides a localized fragrance. The fragrance pockets 46 and the opening 50 therein are located so that the convention of air arising from flushing of a urinal causes an air flow across the openings 50 to pull a small "puff" of fragrance out of the pockets 46.

Preferably, a hinged cover 52 encloses the body and cap. Hinged cover is movable between a closed and open position and preferably has a key locking mechanism 54 to keep the inline sanitary conditioning system secure from tampering. Key locking mechanism includes a post 53 which can be removable or preferably attached to the cover with a stem 55 fitted in latch 57, that rotates to move rod 59 between the locked and unlocked positions. Keyholes, preferably provided in the end of the post 53, are engaged by a key to rotate the post 53. The post and key can have any shape or configuration.

In general, the above components will be fabricated from plastic materials to reduce cost. This is possible because the sanitary conditioning apparatus 10 is placed on the low pressure side of the flush valve. In such case, the plastic, which may be an ABS plastic or equivalently durable materials, is chrome or nickel plated, or can have any other finish applied by any method, to protect the plastic from undesirable alteration of the polymer structure from fragrance oils or sanitary conditioning fluids. Of course, the sanitary conditioning apparatus 10 may also be fabricated from steel, brass or any other durable material.

Preferably, the inline sanitary conditioning system 10 further comprises an electronic sensing and signaling apparatus 56 to keep track of the number of times a person uses the toilet or urinal, to permit monitoring and signaling when a replacement sanitary conditioning tablet and/or air freshener is required.

In one preferred embodiment, the electronic sensing and signaling apparatus 56 comprises means for detecting the proximity of a person to the toilet or urinal; means for storing a sum representing a total of the number of detections determined by the detecting means; means for comparing the stored sum with a predetermined number; and means for displaying a replacement signal when the comparing means determines that the stored sum exceeds the predetermined number. When the signal is displayed, maintenance personnel are alerted to the need to replace the solid tablet and/or air freshening materials. The detecting means is a coded infrared emitter 60 and detector 58. In this system, the detector 58 causes apparatus 56 to prepare to register a count if the detector 58 detects the reflection of the correctly coded (pulsed) infrared beam from the transmitter 60 for a period exceeding 8 seconds. This time period is suitable to confirm the presence of a person using the urinal, and avoids false counts from transient reflections of the Infrared beam. When the sensing apparatus 56 detects a user of the urinal, it causes the lower light emitting diode 62 to blink, with a steady single blink. When the user walks away from the urinal, the blinking diode 62 is turned off, and the count is registered. The number of counts so registered is stored and when the number of registered counts exceeds a preset number, the diode 62 of apparatus 56 will begin blinking to signal the need for replacement of the sanitary conditioning tablet 44.

In the preferred embodiment, the predetermined number is either 2000 or 4000, i.e., the diode 62 will flash to alert the need for a replacement tablet after 2000, or 4000, persons have activated the sensor. The selection of the 2000 or 4000 flush number (or some other number) will depend on the particular sanitary conditioning tablet used in the system. It is also possible to have the predetermined number be selectable between different numbers upon replacement of the sanitary conditioning tablet by using a magnet 70 placed inside of the end cap 34, the magnet 70 thereby operating upon a switch provided in the circuit board of apparatus 56.

In addition to the replacement signal, a signal for low battery conditions may also be provided. It one preferred embodiment, the signal for both the replacement and the low battery conditions is the same light emitting diode 62, set to provide different signals where tablet replacement is required, and where there is a low battery condition. Most preferably, the same light emitting diode 62 is used to (1) indicate that a user has been detected, by emitting a flash at a cycle of about once per second after an 8 second confirmation period; (2) indicate the need for replacement of the battery powering the apparatus 56, by continuously emitting a flash at a cycle of about 1 flash per second; (3) indicate the need for replacement of the sanitary conditioning tablet, by continuously emitting a flash at a cycle of about 2 flashes per second, when the counting circuit determines that the number of users has exceeded the preset count; (4) indicate the need for replacement of the fragrance pillows and/or the sanitary conditioning tablet after a 30 day period of use, by continuously emitting a flash at a cycle of about 3 flashes per second.

The present invention is suitable for both new installation and retrofit into existing urinal toilet facilities. It is simple to install in new applications, requiring only an additional piping step to install it inline between the flush valve and the bowl. It is also simple to install in retrofit applications, requiring removal and replacement of the existing downpipe from the flush valve to the bowl with appropriately sized piping and the apparatus 20.

The invention provides a more effective and hygienic toilet and urinal cleaning system, as the dissolved sanitary conditioning solution is spread widely in the bowl by the flush. This is in contrast to drip systems which typically only drip down the centerline of the urinal.

The present invention provides considerable advantages over the prior art devices by providing direct inline dispensing of deodorizing/sanitary conditioning solution. It does not create problems of overflow conditions associated with many prior art systems that require a cyclic flow of water through a reservoir. It can be easily installed without special plumbing. It dispensing action is simple and immediate, not requiring special pumps, wicking systems or electronics to provide dispensing of the deodorizing/sanitary conditioning solution.

We claim:

1. In a toilet or urinal system, said toilet or urinal system having a flush valve, a flush line connecting said flush valve to an inlet of a bowl of said toilet or urinal, the improvement comprising an inline sanitary conditioning apparatus, having:

a hollow body, said body having open upper and lower ends and being mounted in said flush line by connecting means provided at said upper and lower ends with said body being inline with said flush line, said body having a chamber therein having a diameter greater than 0.25 inch, said body having a laterally extending aperture connecting to said chamber;

a cage provided through said aperture and into said chamber, said cage having a diameter which is less than the diameter of said chamber, said cage having radially extending tabs being mounted within a solid end cap, said end cap having a diameter greater than said cage diameter and greater than a diameter of said aperture;

cooperating means provided on said end cap and said body to permit said end cap to be sealingly mounted to said body to cover said aperture, with said cage located within said chamber;

a solid tablet comprised of a soluble sanitary conditioning material retained in said cage;

a portion of said solid tablet dissolving to form a sanitary conditioning solution which is delivered to said bowl of said toilet or urinal upon actuation of said flush valve causing water to flow through said upper end of said body into said chamber of said inline sanitary conditioning apparatus and then to said bowl of said toilet or urinal.

2. In a toilet or urinal system in accordance with claim 1, further comprising an electronic sensing and signaling apparatus having means for detecting the proximity of a person to said toilet or urinal;

means for storing a sum representing a total of the number of detections determined by said detecting means;

means for comparing said stored sum with a predetermined number;

means for displaying a signal indicating the need for replacement of said sanitary conditioning tablet when said comparing means determines that said stored sum exceeds said predetermined number.

3. In a toilet or urinal system in accordance with claim 2, wherein said electronic sensing and signaling apparatus further comprises clock means for determining a number of days since reset;

means for storing a sum representing a total of the number of days since reset;

means for comparing said stored sum with a predetermined number of days;

means for displaying a signal indicating a need for replacement of an air freshener when said comparing means determines that said stored sum exceeds said predetermined number of days.

4. In a toilet or urinal system in accordance with claim 3 wherein said chamber has a diameter of about 1.75 inches.

5. In a toilet or urinal system in accordance with claim 3, further comprising at least one pocket for receiving an air freshening material provided on a lateral side of said body, said pocket having openings to permit venting of an air freshening fragrance from said pocket.

6. In a toilet or urinal system in accordance with claim 1, further comprising a lockable movable cover enclosing said body and cap.

7. In a toilet or urinal system, said toilet or urinal system having a flush valve, a flush line connecting said flush valve to an inlet of a bowl of said toilet or urinal, the improvement comprising an inline sanitary conditioning apparatus, having:

a hollow body, said body having open upper and lower ends and being mounted in said flush line by connecting means provided at said upper and lower ends with said body being inline with said flush line, said body having a chamber therein having a diameter greater than 0.25 inch, said body having a laterally extending aperture connecting to said chamber;

a cage provided through said aperture and into said chamber, said cage having a diameter which is less than the diameter of said chamber, said cage being mounted to a solid end cap, said end cap having a diameter greater than said cage diameter and greater than a diameter of said aperture;

cooperating means provided on said end cap and said body to permit said end cap to be sealingly mounted to said body to cover said aperture, with said cage located within said chamber;

a solid tablet comprised of a soluble sanitary conditioning material retained in said cage;

at least one pocket for receiving an air freshening material provided on a lateral side of said body, said pocket having openings to permit venting of an air freshening fragrance from said pocket; and a movable cover enclosing said body and cap;

a portion of said solid tablet dissolving to form a sanitary conditioning solution which is delivered to said bowl of said toilet or urinal upon actuation of said flush valve causing water to flow through said upper end of said body into said chamber of said inline sanitary conditioning apparatus and then to said bowl of said toilet or urinal.

8. In a toilet or urinal system in accordance with claim 7 wherein said chamber has a diameter of about 1.75 inches.

9. In a toilet or urinal system in accordance with claim 7 further comprising an electronic sensing apparatus having means for detecting the proximity of a person to said toilet or urinal;

means for storing a sum representing a total of the number of detections determined by said detecting means;

means for comparing said stored sum with a predetermined number;

means for displaying a signal when said comparing means determines that said stored sum exceeds said predetermined number.

10. In a toilet or urinal system in accordance with claim 9 wherein said electronic sensing and signaling apparatus further comprises clock means for determining a number of days since reset;

means for storing a sum representing a total of the number of days since reset;

means for comparing said stored sum with a predetermined number of days;

means for displaying a signal indicating a need for replacement of said air freshening material when said comparing means determines that said stored sum exceeds said predetermined number of days.

* * * * *